US005887708A

United States Patent [19]

Gonzales

[11] Patent Number: 5,887,708

[45] Date of Patent: Mar. 30, 1999

[54] PAINT TRAY COVER

[76] Inventor: Adolpho R. Gonzales, 21006 Cimarron Pkwy., Katy, Tex. 77450

[21] Appl. No.: 915,746

[22] Filed: Aug. 21, 1997

[51] Int. Cl.[6] ..... B65D 33/00

[52] U.S. Cl. ..... 206/209; 206/349; 206/525; 383/70; 383/105

[58] Field of Search ..... 206/205, 207, 206/209, 1.7, 1.8, 1.9, 525, 349; 383/42, 62, 70, 92, 100, 103, 105

[56] References Cited

U.S. PATENT DOCUMENTS 2,373,209 4/1945 Vadnais ..... 383/103 X
2,664,358 12/1953 Eichler ..... 383/103 X
3,495,764 2/1970 Crane ..... 383/103
3,546,327 12/1970 Ruda ..... 383/103 X

*Primary Examiner*—Jacob K. Ackun

[57] ABSTRACT

A new PAINT TRAY COVER for ELIMINATING THE NEED TO CLEAN THE TRAY AFTER PAINTING. The inventive device includes a bag dimensioned for receiving a paint tray therein. The bag has an open end for receiving the paint tray therein. The bag has an upper surface, a lower surface and a hollow interior therebetween. The lower surface has a first pair of holes therethrough in a spaced relationship. The first pair of holes are dimensioned for receiving a pair of feet of the paint tray therethrough. The bag is closeable around the paint tray and will conform to the paint tray once the tray is filled with paint.

1 Claim, 2 Drawing Sheets

FIG 3
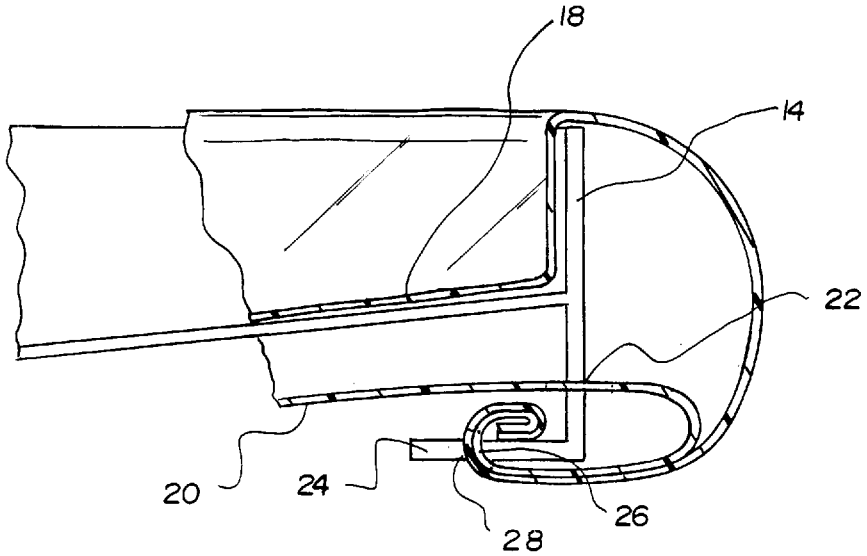
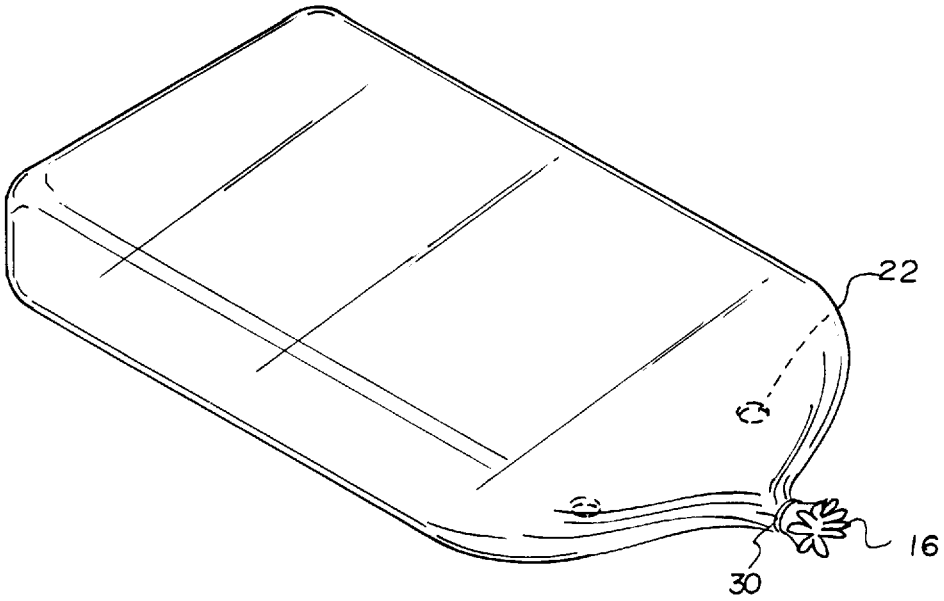
FIG 4

PAINT TRAY COVER

BACKGROUND OF THE INVENTION

1. Field of the Invention

The present invention relates to PAINT LINERS and more particularly pertains to a new PAINT TRAY COVER for ELIMINATING THE NEED TO CLEAN THE TRAY AFTER PAINTING.

2. Description of the Prior Art

The use of PAINT LINERS is known in the prior art. More specifically, PAINT LINERS heretofore devised and utilized are known to consist basically of familiar, expected and obvious structural configurations, notwithstanding the myriad of designs encompassed by the crowded prior art which have been developed for the fulfillment of countless objectives and requirements.

Known prior art PAINT LINERS include U. S. Pat. No. Des. 289,456 to Florentino; U.S. Pat. No. 4,765,123 to Caldwell; U.S. Pat. No. Des. 264,897 to Smith; U.S. Pat. No. 5,143,242 to Millasich; U.S. Pat. No. 4,832,228 to Hickey; and U.S. Pat. No. 4,151,929 to Sapien.

While these devices fulfill their respective, particular objectives and requirements, the aforementioned patents do not disclose a new PAINT TRAY COVER. The inventive device includes a bag dimensioned for receiving a paint tray therein. The bag has an open end for receiving the paint tray therein. The bag has an upper surface, a lower surface and a hollow interior therebetween. The lower surface has a first pair of holes therethrough in a spaced relationship. The first pair of holes are dimensioned for receiving a pair of feet of the paint tray therethrough. The bag is closeable around the paint tray and will conform to the paint tray once the tray is filled with paint.

In these respects, the PAINT TRAY COVER according to the present invention substantially departs from the conventional concepts and designs of the prior art, and in so doing provides an apparatus primarily developed for the purpose of ELIMINATING THE NEED TO CLEAN THE TRAY AFTER PAINTING.

SUMMARY OF THE INVENTION

In view of the foregoing disadvantages inherent in the known types of PAINT LINERS now present in the prior art, the present invention provides a new PAINT TRAY COVER construction wherein the same can be utilized for ELIMINATING THE NEED TO CLEAN THE TRAY AFTER PAINTING.

The general purpose of the present invention, which will be described subsequently in greater detail, is to provide a new PAINT TRAY COVER apparatus and method which has many of the advantages of the PAINT LINERS mentioned heretofore and many novel features that result in a new PAINT TRAY COVER which is not anticipated, rendered obvious, suggested, or even implied by any of the prior art PAINT LINERS, either alone or in any combination thereof.

To attain this, the present invention generally comprises a bag dimensioned for receiving a paint tray therein. The bag has an open end for receiving the paint tray therein. The bag has an upper surface, a lower surface and a hollow interior therebetween. The lower surface has a first pair of holes therethrough in a spaced relationship. The first pair of holes are dimensioned for receiving a pair of feet of the paint tray therethrough. The lower surface has a second pair of holes therethrough in a spaced relationship disposed between the first pair of holes and the open end. The upper surface has a third pair of holes therethrough in a spaced relationship disposed above the second pair of holes. The second pair of holes and the third pair of holes are aligned for coupling with the pair of feet of the paint tray for engagement of the bag to the paint tray.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new PAINT TRAY COVER apparatus and method which has many of the advantages of the PAINT LINERS mentioned heretofore and many novel features that result in a new PAINT TRAY COVER which is not anticipated, rendered obvious, suggested, or even implied by any of the prior art PAINT LINERS, either alone or in any combination thereof.

It is another object of the present invention to provide a new PAINT TRAY COVER which may be easily and efficiently manufactured and marketed.

It is a further object of the present invention to provide a new PAINT TRAY COVER which is of a durable and reliable construction.

An even further object of the present invention is to provide a new PAINT TRAY COVER which is susceptible of a low cost of manufacture with regard to both materials and labor, and which accordingly is then susceptible of low prices of sale to the consuming public, thereby making such PAINT TRAY COVER economically available to the buying public.

Still yet another object of the present invention is to provide a new PAINT TRAY COVER which provides in the apparatuses and methods of the prior art some of the advantages thereof, while simultaneously overcoming some of the disadvantages normally associated therewith.

Still another object of the present invention is to provide a new PAINT TRAY COVER for ELIMINATING THE NEED TO CLEAN THE TRAY AFTER PAINTING.

Yet another object of the present invention is to provide a new PAINT TRAY COVER which includes a bag dimensioned for receiving a paint tray therein. The bag has an open end for receiving the paint tray therein. The bag has an upper surface, a lower surface and a hollow interior therebetween. The lower surface has a first pair of holes therethrough in a spaced relationship. The first pair of holes are dimensioned for receiving a pair of feet of the paint tray therethrough. The bag is closeable around the paint tray and will conform to the paint tray once the tray is filled with paint.

Still yet another object of the present invention is to provide a new PAINT TRAY COVER that is disposable thereby eliminating the need to clean a paint tray.

Even still another object of the present invention is to provide a new PAINT TRAY COVER that conforms to the bottom of the paint tray.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a sectional side view of the present invention shown in cross-section to illustrate the coupling to the paint tray.

FIG. 4 is a perspective view of an alternate embodiment of the present invention.

DESCRIPTION OF THE PREFERRED EMBODIMENT

Figure 1:
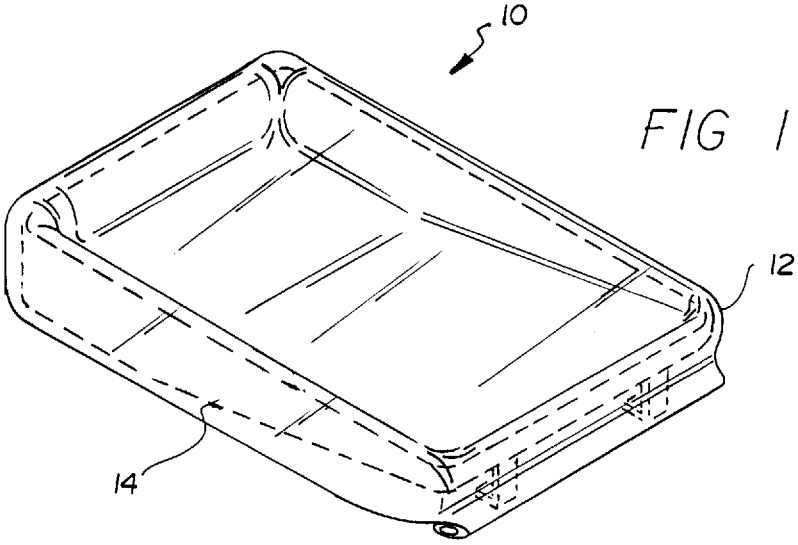
FIG. 1 a perspective view of a new PAINT TRAY COVER according to the print invention shown in place on a paint tray.
Figure 2:
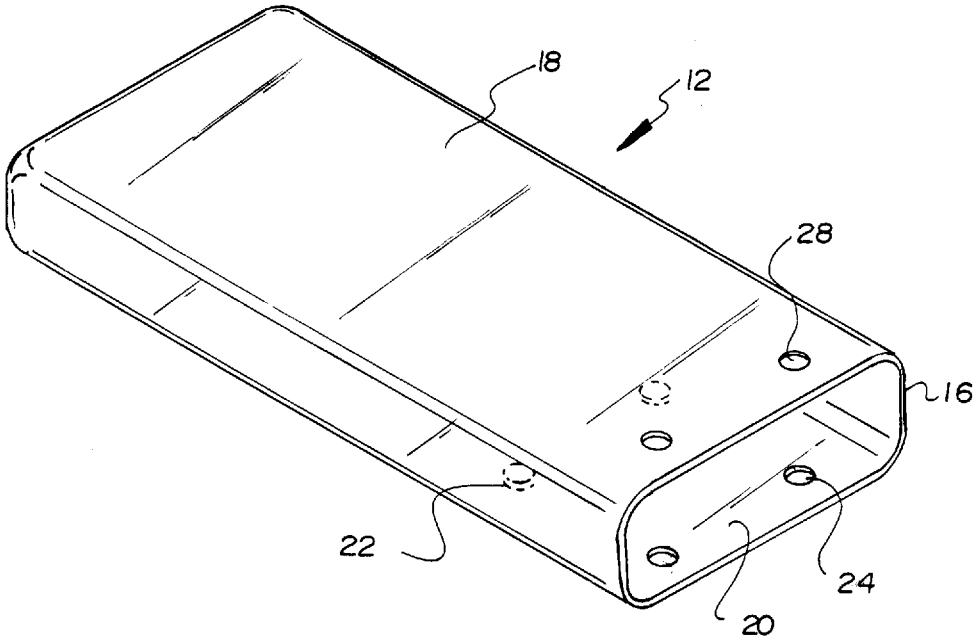
FIG. 2 is an isolated perspective view of the present invention.

With reference now to the drawings, and in particular to FIGS. 1 through 4 thereof, a new PAINT TRAY COVER embodying the principles and concepts of the present invention and generally designated by the reference numeral 10 will be described.

As best illustrated in FIGS. 1 through 4, the PAINT TRAY COVER 10 comprises a bag 12 dimensioned for receiving a paint tray 14 therein. The bag 12 has an open end 16 for receiving the paint tray 14 therein. The bag 12 is fabricated of a plastic material. The plastic selected for use in this device 10 would have to be chemically-resistant to withstand prolonged contact with latex or oil-based paints. The bag 12 has an upper surface 18, a lower surface 20 and a hollow interior therebetween. The lower surface 20 has a first pair of holes 22 therethrough in a spaced relationship. The first pair of holes 22 are dimensioned for receiving a pair of feet 24 of the paint tray 14 therethrough. The lower surface 20 has a second pair of holes 26 therethrough in a spaced relationship disposed between the first pair of holes 22 and the open end 16. The upper surface 18 has a third pair of holes 28 therethrough in a spaced relationship disposed above the second pair of holes 26. The second pair of holes 26 and the third pair of holes 28 are aligned for coupling with the pair of feet 24 of the paint tray 14 for engagement of the bag 12 to the paint tray 14. The paint tray 14 is positioned within the bag 12 with the feet 24 received through the first pair of holes 22. The open end 16 of the bag is pinched together so that the second and third pair of holes are in alignment so that the bag 12 is wrapped under the front edge of the paint tray 14 and passed under the tray 14 to be coupled over the feet 24. Note FIG. 3.

An alternate embodiment of the present invention is illustrated in FIG. 4 which eliminates the need for the second and third pair of holes. Instead, a twist tie 30 is provided to close the open end 16 of the bag 12.

In use, the bag 12 is positioned over a paint tray 14, and the user can then fill the tray 14 as paint as usual. The paint would cause the plastic of the bag 12 to conform to the bottom of the tray 14, and the bag 12 would be unlikely to slip because of the way it is secured under the tray 14. The bag 12 will keep the tray 14 clean throughout the course of the painting project, so the painter could save time and effort that would have otherwise been spent in cleaning the tray 14 at the end of the day. Additionally, the bags 12 could also be used to wrap up his/her roller covers and brushes to keep them from drying out overnight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint tray system for eliminating cleaning of a paint tray after painting comprising, in combination:

a paint tray having a bottom wall and four side walls extending upward to form a pan for holding liquid paint, the paint tray having a pair of support feet extending downwardly from a bottom surface of the bottom wall of the tray, the pair of legs being positioned adjacent one of the side walls;

a bag dimensioned for receiving the paint tray therein, the bag having an interior with an open end, the paint tray being positioned in the interior of the bag, the bag having an upper continuous panel for conforming to the pan of the paint tray to form a reservoir for receiving paint such that the paint contacts the upper continuous panel whereby paint is retained by the side and bottom walls and prevented from contacting an upper surface of the paint tray;

the bag further having a lower continuous panel, the lower panel having a first pair of holes equidistant from the open end of the bag, the first pair of holes receiving the pair of feet of the paint tray therethrough, the lower panel having a second pair of holes disposed between the first pair of holes and the open end, the upper panel having a third pair of holes, the second and third pairs of holes being equidistant from the open end, the second pair of holes and the third pair of holes being substantially aligned such that the upper and lower panels of the bag extending past one of the side walls are foldable with the second and third pairs of holes receiving the pair of feet of the paint tray for retaining the bag on the paint tray during use.

* * * * *